US005647296A

United States Patent [19]

Pasanen

[11] Patent Number: 5,647,296

[45] Date of Patent: Jul. 15, 1997

[54] SHOCK DAMPER FOR A BOAT

[76] Inventor: Pertti Pasanen, Ilmalankatu 2, FIN-00240 Helsinki, Finland

[21] Appl. No.: 632,433

[22] PCT Filed: Oct. 20, 1994

[86] PCT No.: PCT/FI94/00471

§ 371 Date: Apr. 22, 1996

§ 102(e) Date: Apr. 22, 1996

[87] PCT Pub. No.: WO95/11157

PCT Pub. Date: Apr. 27, 1995

[30] Foreign Application Priority Data

Oct. 22, 1993 [FI] Finland ..... 934663
Sep. 5, 1994 [FI] Finland ..... 944063

[51] Int. Cl.[6] ..... B63B 1/24

[52] U.S. Cl. ..... 114/279; 114/219

[58] Field of Search ..... 114/271, 274, 114/270, 279, 284, 361, 221 R, 219

[56] References Cited

U.S. PATENT DOCUMENTS 2,776,637 1/1957 Chadwick .
3,636,907 1/1972 Scarritt, Sr. .
3,641,963 2/1972 Chancellor, Jr. .
3,670,684 6/1972 Helker .
3,703,877 11/1972 Ueda ..... 114/270

FOREIGN PATENT DOCUMENTS 2833 095 7/1978 Germany .
2-169384 2/1988 Japan .
46604 2/1920 Sweden .

*Primary Examiner*—Jesus D. Sotelo
*Attorney, Agent, or Firm*—Michael A. O'Neil; Russell N. Rippamonti

[57] ABSTRACT

A shock damper for a boat includes an impact plate flexibly mounted to the bow of the boat and extending longitudinally along the central axis of the boat. The leading edge of the impact plate is located in front of the bow and above the surface of the water when the boat is moving forward in calm water. The trailing edge is located along the longitudinal axis of the boat beneath the surface of the water. The impact plate is angularly disposed with the leading edge directed obliquely upwards and the leading edge is displaced from the bow a greater distance than the trailing edge.

11 Claims, 1 Drawing Sheet

SHOCK DAMPER FOR A BOAT

The present invention relates to a shock damper for a boat, which is mounted below and in front of the bow of a boat and serves as a device for damping the shocks or impacts generated by waves.

This type of shock damper is prior known from the patent publication U.S. Pat. No. 3,641,963. This prior known shock damper is only flexible in the longitudinal direction of a boat and, thus, the line of action does not comply with various forms of waves. The shock damper does not ride on top of the waves but sends the splash water flying on the sides and forward in the air with water falling into the boat.

An object of the invention is to provide a shock damper for a boat, which does not impair the handling characteristics of a boat yet serves effectively as a shock damper by lifting the bow up before the bow hits the water, thus reducing the side splashes produced by waves hitting the sides of the bow.

A second object of the invention is to provide an improved shock damper, which eliminates the forward flying of splash water and rises or tends to rise on top of the wave by adapting itself to the surface of waves having varying shapes.

A particular additional object of the invention is to provide a shock damper, which serves as a shock damper over an extensive area both within the bow and forward part of the bottom, i.e. within the area which is not in contact with water in normal driving. The shock damper must be flexible in a manner that protects a boat from vibration in view of providing a pleasant ride.

These objects are achieved on the basis of the characterizing features set forth in the appended claims. The scope of protection is defined by the allowed claims.

One exemplary embodiment of the invention will now be described in more detail with reference made to the accompanying drawings, in which FIG. 1 shows a side view of the fore part of a boat provided with a shock damper of the invention;

Figure 3:
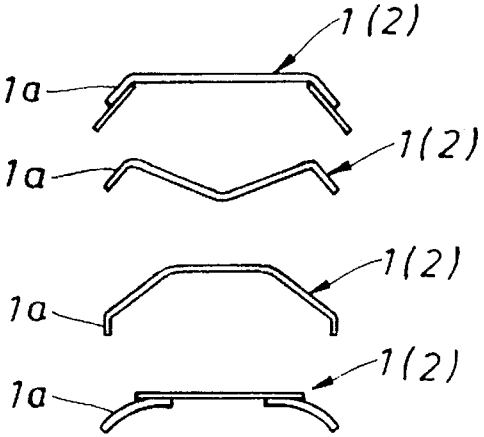
FIG. 3 shows alternative cross-sectional shapes for a shock damper as a section along a line III—III in FIG. 1.
Figure 1:
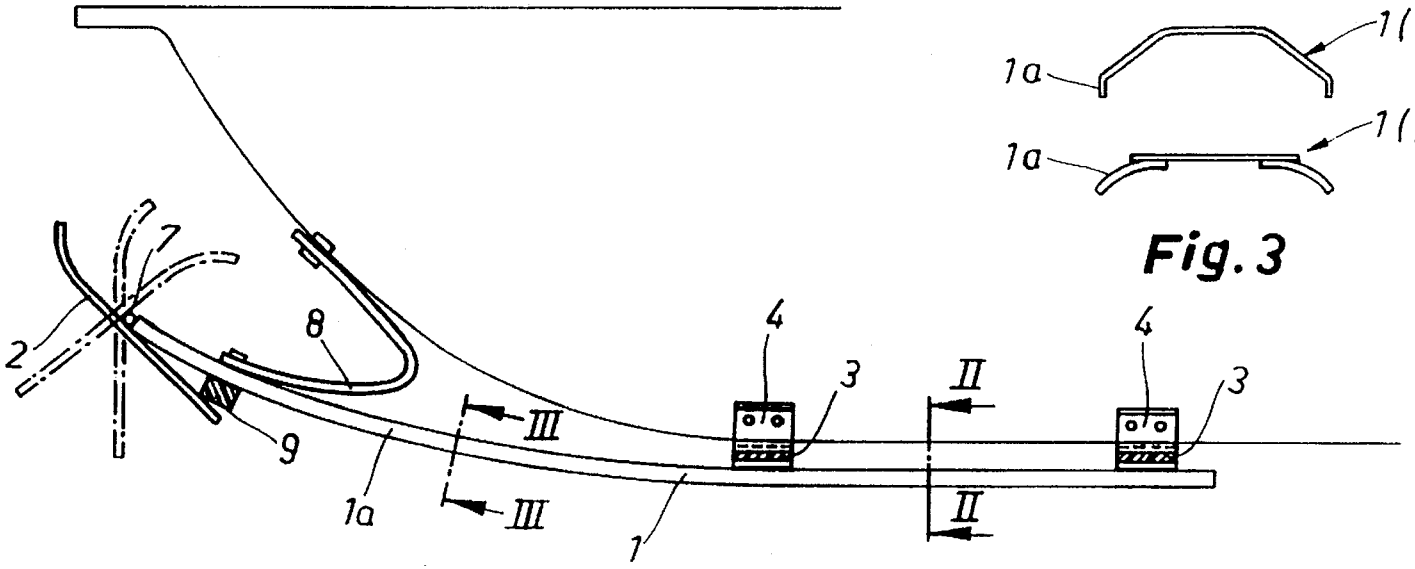
Figure 2:
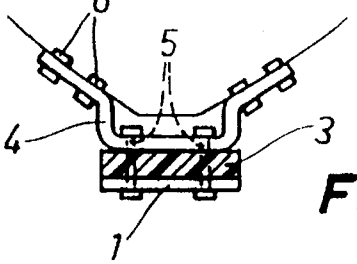
FIG. 2 shows a section along a line II—II in FIG. 1.

To the bottom of a boat, below the bow section is fastened by means of bolts 5 a leaf spring 1, which is made of a fiber-reinforced plastic, a so-called composite material. Fitted between the spring 1 and the bottom of a boat are vibration absorbing rubber pads 3 as well as mounting strips 4 which are fastened to the bottom of a boat by means of bolts or screws 6. The mounting strips 4 facilitate the attachment of a shock damper to bottoms of various shapes. The spring 1 has its leading end curving upwards but gently enough to diverge from the bow rib of a boat. The leading end of the spring 1 is provided with a pivot hinge 7 for mounting an impact plate or ski 2 whose material and shape can be the same as those of the curved leading section of the spring 1. The cross-sectional shape of the leading end of the spring 1 and that of the ski 2 is a shallow trough whose edges 1*a* are directed downwards or obliquely downwards. FIG. 3 illustrates a few examples of possible cross-sectional shapes. The spring 1 and the ski 2 may have a width which is within the range of 100–250 mm, typically within the range of 150–200 mm. The edges 1*a* may have a height which is e.g. 30 mm. The dimensions are correspondingly larger in larger boats. At the mounting points 4 said spring 1 may be in a flat shape without downwards extending edges 1*a*.

The spring 1 and the ski 2 are located along the centre line of a boat in the longitudinal direction thereof.

The ski 2 is freely pivotable and the hinge point 7 is located slightly above the median line whereby, during the driving, the air pressure and/or waves keep the ski 2 in an inclined impact position, wherein its tail end rests against a rubber pad 9 secured to the bottom surface of the spring 1. Between the leading end of the spring 1 and the bow of a boat is fitted a spring 8, which supports the leading end of the spring 1 and together with the spring 1 provides a shock receiving spring force. At rest, the ski 2 is capable of pivoting to an upright position. When a high wave hits the ski, the ski turns into alignment with the side of the wave and the spring 1 bends towards the bow of a boat whereby the ski rises on top of the wave rather than tries to split the wave. At the same time the side edges 1*a* curb the sideways flying of splashes.

When docking a boat, said ski 2 and spring 8 function as an impact protector. When reversing, the ski 2 is able to pivot in such a manner that its tail end glides along the surface of water. In the upright position, the ski remains underneath the foremost section of a boat and, thus, the ski is not in the way when entering or leaving a boat.

The curvature of the leading end of the leaf spring 1 and the position of the ski 2 are selected in such a manner that, when driving in calm water, the leading end of the spring 1 and the ski 2 are above the surface of water. The curved leading section of the leaf spring 1 and the tail end of the ski 2 take up low waves. High waves reach also above the hinge 7 included in the ski 2. When leaning against the rubber pad, the ski 2 forms an angle relative to the longitudinal direction of a boat, said angle being within the range of 30°–60°.

The invention is not limited to the above exemplary embodiment but the structural details may vary in many ways within the scope of the appended claims. Even though the hinged ski 2 is preferred in the case of high waves, the invention functions even without it by virtue of the position, curvature and flexibility of the leaf spring 1.

I claim:

1. A shock damper for a boat, said boat having a bow and a central longitudinal axis, said shock damper comprising:

an impact plate flexibly mounted to the bow of the boat and extending longitudinally along the central axis of the boat, said impact plate having a leading edge and a trailing edge, said leading edge located in front of the bow and above the surface of the water when the boat is moving forward in calm water, said trailing edge located along the longitudinal axis of the boat beneath the surface of the water, said impact plate angularly disposed with the leading edge directed obliquely upwards, said leading edge displaced from the bow a greater distance than said trailing edge, and said impact plate including a front portion located proximal to the leading edge and a second portion located proximal to the trailing edge, said front portion flexibly fastened to the center of the bow by a first spring means and said second portion flexibly fastened to the bow of the boat along the central longitudinal axis by a second spring means.

2. A shock damper for a boat, said boat having a bow and a central longitudinal axis, said shock damper comprising:

an impact plate flexibly mounted to the bow of the boat and extending longitudinally along the central axis of the boat, said impact plate having a leading edge located in front of the bow and a trailing edge, said leading edge located in front of the bow and said trailing edge located along the longitudinal axis of the boat beneath the surface of the water, said impact plate angularly disposed with the leading edge directed obliquely upwards, said leading edge displaced from the bow a greater distance than said trailing edge, and the leading edge of the impact plate being configured in the shape of a shallow trough with edges directed downwards.

3. A shock damper for a boat, said boat having a bow and a central longitudinal axis, said shock damper comprising:

an impact plate flexibly mounted to the bow of the boat and extending longitudinally along the central axis of the boat, said impact plate having a leading edge located in front of the bow and a trailing edge, said leading edge located in front of the bow and said trailing edge located along the longitudinal axis of the boat beneath the surface of the water, said impact plate angularly disposed with the leading edge directed obliquely upwards, said leading edge displaced from the bow a greater distance than said trailing edge, and the impact plate includes a front portion located proximal to the leading edge and wherein said front portion of the impact plate is flexibly fastened to the center of the bow by a first spring means.

4. The shock damper of claim 3 wherein the first spring means is a "V" shaped leaf spring having a first leg and a second leg and wherein the first leg is attached to the front portion of the impact plate and the second leg is attached to the center axis of the bow of the boat along the central longitudinal axis of the boat.

5. A shock damper for a boat, said boat having a bow and a central longitudinal axis, said shock damper comprising:

an impact plate flexibly mounted to the bow of the boat and extending longitudinally along the central axis of the boat, said impact plate having a leading edge located in front of the bow and a trailing edge, said leading edge located in front of the bow and said trailing edge located along the longitudinal axis of the boat beneath the surface of the water, said impact plate angularly disposed with the leading edge directed obliquely upwards, said leading edge displaced from the bow a greater distance than said trailing edge, and the impact plate includes a front portion located proximal to the leading edge and a second portion located proximal to the trailing edge, wherein said second portion of the impact plate is flexibly fastened to the bow of the boat along the central longitudinal axis of the boat by at least one second spring means.

6. The shock damper of claim 5 wherein the second spring means includes:

a "U" shaped mounting clamp having a first leg, a second leg, and a bottom section, wherein the first leg of the "U" shaped clamp is attached to the bow of the boat to the right of the central longitudinal axis and the second leg is attached to the bow of the boat to the left of the central longitudinal axis; and a vibration absorbing rubber pad attached on a first side of the bottom section of the "U" shaped clamp and attached on a second side to the impact plate.

7. A shock damper for a boat, said boat having a bow and a central longitudinal axis, said shock damper comprising:

a composite fiber reinforced impact plate flexibly mounted to the bow of the boat and extending longitudinally along the central axis of the boat, said impact plate having a leading edge located in front of the bow and a trailing edge, said leading edge located in front of the bow and said trailing edge located along the longitudinal axis of the boat beneath the surface of the water, said impact plate angularly disposed with the leading edge directed obliquely upwards, said leading edge displaced from the bow a greater distance than said trailing edge, and said impact plate including a front portion located proximal to the leading edge and a second portion located proximal to the trailing edge, said front portion flexibly fastened to the center of the bow by a first spring means and said second portion flexibly fastened to the bow of the boat along the central longitudinal axis by a second spring means.

8. A shock damper for a boat, said boat having a bow and a central longitudinal axis, said shock damper comprising:

an impact plate flexibly mounted to the bow of the boat and extending longitudinally along the central axis of the boat, said impact plate having a leading edge located in front of the bow and a trailing edge, said leading edge located in front of the bow and said trailing edge located along the longitudinal axis of the boat beneath the surface of the water, said impact plate angularly disposed with the leading edge directed obliquely upwards, said leading edge displaced from the bow a greater distance than said trailing edge, and a ski pivotally attached to the leading edge of the impact plate and extending longitudinally along the central longitudinal axis of the boat.

9. The shock damper of claim 8 wherein the leading edge of the ski is configured in the shape of a shallow trough with edges directed downwards.

10. The shock damper of claim 8 wherein the ski includes: a front end; a rear end; and a central lateral axis; said ski being pivotally mounted to the impact plate slightly displaced toward the front of the ski from the central lateral axis of the ski.

11. The shock damper of claim 10 further including a flexible pad attached to the bottom of the impact plate and positioned such that the rear end of the ski contacts against the flexible pad.

* * * * *